US010107586B2

(12) United States Patent
Derousse

(10) Patent No.: US 10,107,586 B2
(45) Date of Patent: Oct. 23, 2018

(54) VERTICAL FORWARD GRIP

(71) Applicant: Damon William Derousse, Red Bud, IL (US)

(72) Inventor: Damon William Derousse, Red Bud, IL (US)

( * ) Notice: Subject to any disclaimer, the term of this patent is extended or adjusted under 35 U.S.C. 154(b) by 0 days.

(21) Appl. No.: 14/998,723

(22) Filed: Feb. 8, 2016

(65) Prior Publication Data

US 2017/0227320 A1 Aug. 10, 2017

Related U.S. Application Data

(60) Provisional application No. 62/119,502, filed on Feb. 23, 2015.

(51) Int. Cl.

| | |
|---|---|
| ***F41A 15/00*** | (2006.01) |
| ***F41C 23/16*** | (2006.01) |
| ***F41C 23/14*** | (2006.01) |
| ***F41C 23/12*** | (2006.01) |
| ***F41C 23/22*** | (2006.01) |

(52) U.S. Cl.
CPC ..... *F41C 23/16* (2013.01); *F41C 23/12* (2013.01); *F41C 23/14* (2013.01); *F41C 23/22* (2013.01)

(58) Field of Classification Search
CPC ..... F41C 23/10; F41C 23/16; F41C 23/22
USPC ..... 42/71.01, 72, 73
See application file for complete search history.

(56) References Cited

U.S. PATENT DOCUMENTS

| | | | | |
|---|---|---|---|---|
| 7,111,424 | B1 * | 9/2006 | Moody | F41A 23/08 248/171 |
| 8,839,544 | B2 * | 9/2014 | Troy | F41C 23/16 42/72 |
| 9,383,163 | B2 * | 7/2016 | Kincel | F41C 23/16 |
| 2016/0116252 | A1 * | 4/2016 | Kincel | F41C 27/00 42/90 |

* cited by examiner

*Primary Examiner* — J. Woodrow Eldred

(57) ABSTRACT

The Vertical Forward Grip is a revolutionary new design, which increases shooter(s) accuracy, providing comfort to the shooter and increasing control of the weapon, while reducing fatigue to the shooter(s) overall stamina. The overall design, ergonomic feel, textured grip placement, ergonomic finger stabilization cradle and the ergonomic thumb-index finger cradle of the vertical forward grip allows the shooter(s) to remain comfortable for long periods, increasing accuracy and control, providing stabilization of the weapon and the design features are different from conventional vertical forward grip(s). Specific design features/improvements are incorporated into the vertical forward grip unlike the design of conventional vertical forward grip(s). Design features and improvements include: finger stabilization cradle, thumb-index finger cradle, textured grip placement, ergonomic grip feature (increased grip control and accuracy), quick turn-and-release base grip cap tube, quick turn-and-release cap tube to remove stored miscellaneous item(s).

11 Claims, 2 Drawing Sheets

VERTICAL FORWARD GRIP

CROSS REFERENCE TO RELATED APPLICATIONS

This application claims the benefit of U.S. Provisional Patent Application No. 62/119,502, filed 23 Feb. 2015.

(Vertical Forward Grip) Field of classification search (42/72; 42/94), International classification (F41A 35/06; F41C 23/12; F41C 23/14; F41C 23/22; F41C 27/00), U.S. classification CPC (42/94; 42/73; F41C 27/00; F41C 27/22; F41C 23/22) and U.S. classification USPC (42/72; 362/110).

STATEMENT REGARDING FEDERALLY SPONSORED RESEARCH OR DEVELOPMENT

Not Applicable.

NAMES OF THE PARTIES TO A JOINT RESEARCH AGREEMENT IF THE CLAIMED INVENTION WAS MADE AS A RESULT OF ACTIVITIES WITHIN THE SCOPE OF A JOINT RESEARCH AGREEMENT

Not Applicable.

REFERENCE TO A "SEQUENCE LISTING," A TABLE, OR A COMPUTER PROGRAM LISTING APPENDIX SUBMITTED ON A COMPACT DISC AND AN INCORPORATION BY REFERENCE OF THE MATERIAL ON THE COMPACT DISC. THE TOTAL NUMBER OF COMPACT DISC INCLUDING DUPLICATES AND THE FILES ON EACH COMPACT DISC SHALL BE SPECIFIED

Not Applicable.

BACKGROUND OF THE INVENTION

A vertical forward grip may consist of a device attached to a Picatinny, Weaver or similar mounting rail system of a short barreled rifle, long barreled rifle, shotgun or related type of firearm. The upper portion of the vertical forward grip may be quickly detached or locked into permanent position via locking mechanism. The vertical forward grip includes an internal storage space for multiple types of batteries and miscellaneous item(s). The vertical forward grip can be adjusted on the rail of the firearm platform to assist with the operator(s) necessities. The vertical forward grip is comprised of an ergonomic configuration suited to the purposes of the operator(s) natural grip and control.

Conventional vertical forward grip(s) provide a less desired grip, creating fatigue on the shooter(s), reducing the shooter(s) accuracy. Conventional vertical forward grips do not stabilize the weapon as well, providing moderate comfort and control. Conventional vertical forward grips do not give the desired control and comfort to the shooter, fatiguing the shooter over long extended periods of use.

Presently there is no solution with a conventional vertical forward grip(s) to increase stability, accuracy, control and comfort of the weapon.

Therefore, it is the design of this current invention that provides a new and improved vertical forward grip for mounting on firearms.

It is another design improvement of this current invention to provide a new and improved vertical forward grip with the implementation of the ergonomic finger stabilization cradle.

It is another design improvement of this current invention to provide a new and improved vertical forward grip with the implementation of the thumb-index finger stabilization cradle.

It is another design improvement of this current invention to provide a new and improved vertical forward grip with the implementation of the improved textured grip placement.

It is another design improvement of this current invention to provide a new and improved vertical forward grip with the implementation of the improved integrated quick turn-and-release base grip cap tube, via quick mounting and removal of the grip.

It is another design improvement of this current invention to provide a new and improved vertical forward grip with the implementation of the quick turn-and-release base grip cap tube.

It is another design improvement of this current invention to provide a new and improved vertical forward grip with the implementation of the quick turn-and-release, removal of stored miscellaneous item(s) inside of the base grip device.

BRIEF SUMMARY OF THE INVENTION

In brief, to attain the preferred design improvement of the invention in accordance with the preferred embodiment thereof, a vertical forward grip is disclosed. The present invention seeks to provide a solution to this problem by providing a more ergonomic feel to the shooter while giving additional stability to the weapon for accuracy/control/comfort to the shooter, with the implementation of the improved texture grip placement, ergonomic finger stabilization cradle and thumb-index finger stabilization cradle.

BRIEF DESCRIPTION OF THE SEVERAL VIEWS OF THE DRAWING

The following changes and specific design improvements of this current invention will become starkly apparent from the following detailed description of the invention, when taken into consideration with the drawings, in which.

DETAILED DESCRIPTION OF THE INVENTION

Figure 1:
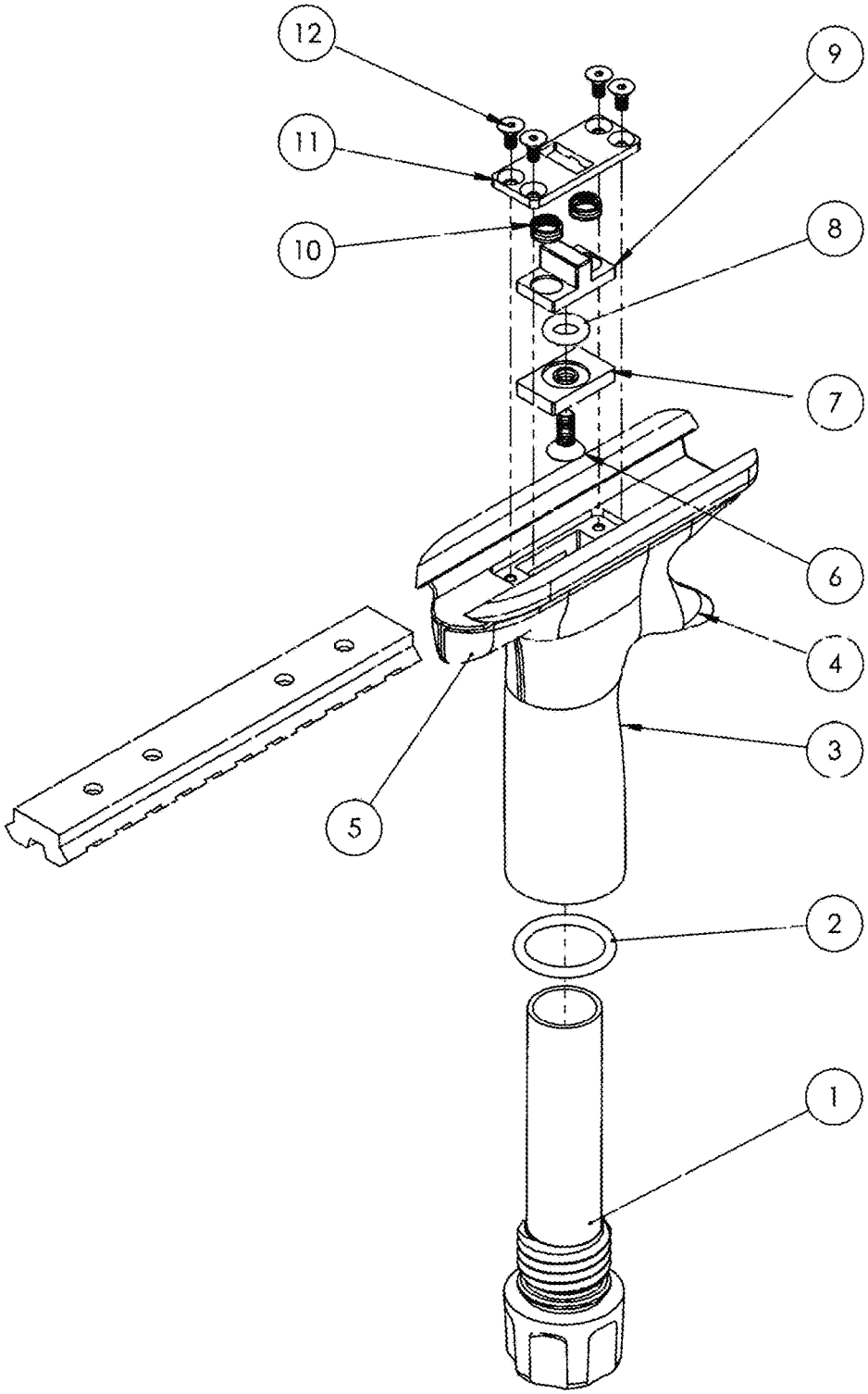
FIG. 1 is an exploded sectional view of the vertical forward grip of FIG. 2, FIG. 3 & FIG. 4.
Figure 2:
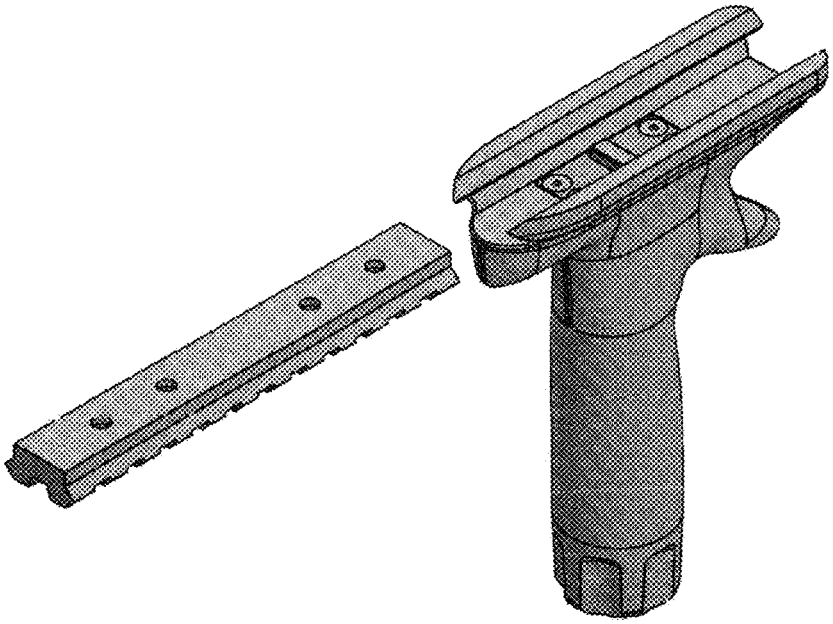
FIG. 2 is a perspective view of the vertical forward grip, in accordance with the present invention.
Figure 3:
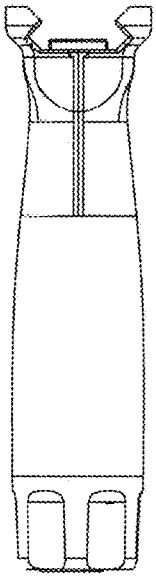
FIG. 3 is a rear view of the vertical forward grip.
Figure 4:
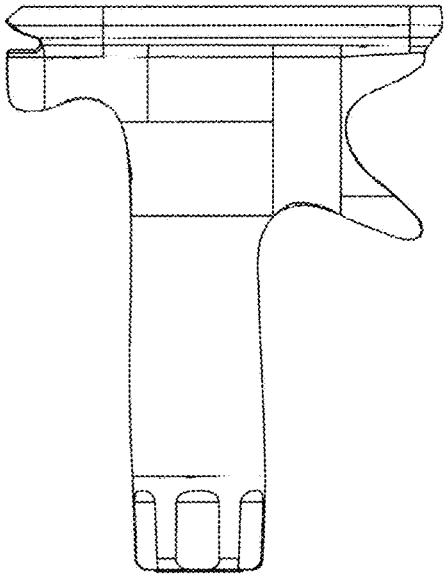
FIG. 4 is a side view of the vertical forward grip.

Turning to FIG. 1, a vertical forward grip in accordance with the current invention, is illustrated. Vertical forward grip 3 includes an improved texture grip placement 3 rear ergonomic thumb-index finger stabilization cradle 4 and 5 integrated with the vertical forward grip and thumb-index finger stabilization cradle 3 includes a lower sealing quick turn-and-release integrated base grip cap tube 1, allowing for storage, quick removal and adjustment/positioning on the lower portion of the rail mounting system. In combination with the quick turn-and-release integrated base grip cap tube 1 and an O-ring 2 is positioned between 1 and 3, to provide a moisture tight seal. Illustrated in FIGS. 2 and 4, the ergonomic configuration is suited to the purposes of the operator(s) natural grip and control per ergonomic finger stabilization cradle and thumb-index finger stabilization cradle 4 & S design. Referring additionally to FIG. 1, a vertical forward grip in accordance with the current invention, is illustrated. Vertical forward grip 3 includes a lower rectangular base mount screw 6 which travels through the center of the lower rectangular base plate 7 and the O-ring 8. The lower rectangular base mount screw 7 is secured into the base of the rectangular bar-shaped mounting clamp 9. The lower rectangular base mount screw 6, secures the lower rectangular base plate 7 to the rectangular bar-shaped mounting clamp 9, securing the O-ring 8 between the base of the rectangular bar-shaped clamp 9 and the upper portion of the lower rectangular base plate 7. The sealed O-ring 8 provides a compressible moisture tight seal between the lower rectangular base plate 7, and the rectangular bar-shaped mounting clamp 9. Referring additionally to FIG. 1, a vertical forward grip in accordance with the current invention, is illustrated. Vertical forward grip 3 includes the upper portion of a rectangular bar-shaped mounting clamp 9. The upper surface of the rectangular bar-shaped mounting clamp 9 has two recessed circular surfaces to secure two retaining springs 10. The two retaining springs 10 interface with the lower base of the upper rectangular spring retention base plate 11. The retaining springs 10 are secured between the upper rectangular spring retention base plate 11 with four base plate retention screws 12. The four base plate retention screws 12 are secured into the upper base of the vertical forward grip 3. In the assembly and operation or positioning of the vertical forward grip 3 and its components 1-12, Illustrated in FIG. 1-4, components 1 and 3 interlock with components 4-12, securing the upper portion of 3 to the rail mounting system via removability and secured among the spaced slots along the lower rail mounting system. Thus the vertical forward grip 3 has a stable platform when secured into place by twisting the quick turn-and-release integrated base grip cap tube 1, which in turn engages the lower rectangular bar-shaped mounting clamp 9 into the slot of the lower portion of the rail mounting system. The vertical forward grips components 1-12 can be quickly adjusted on the rail of the firearm platform to assist with the operator(s) necessities. The vertical forward grip 3 is comprised of an ergonomic configuration suited to the purposes of the operator(s) natural grip, comfort and control, reducing fatigue on the operator and increasing the shooters accuracy and stabilization of the weapon.

Therefore, a new and improved vertical forward grip design is shown and described. The new and improved vertical forward grip is designed to provide a solution to this problem by providing a more ergonomic feel for the shooter while giving additional stability to the weapons and accuracy/control/comfort to the shooter, with the implementation of the improved texture grip placement, ergonomic finger stabilization cradle and thumb-index finger stabilization cradle.

This vertical forward grip is a revolutionary new design, which increases shooter(s) accuracy, providing comfort to the shooter and increasing control of the weapon, while reducing fatigue to the shooter(s) overall stamina. The overall design, ergonomic feel, textured grip placement, the ergonomic finger stabilization cradle and the thumb-index finger stabilization cradle of the vertical forward grip allows the shooter(s) to remain comfortable for long periods, increasing accuracy and control, and new design features are different from conventional vertical forward grip(s). Specific design features/improvements are incorporated into the vertical forward grip unlike the design of conventional vertical forward grip(s). Design features and improvements include: finger stabilization cradle, thumb-index finger stabilization cradle, textured grip placement, ergonomic grip feature (increased grip control and accuracy), quick turn-and-release base grip cap tube, quick turn-and-release cap tube to remove stored miscellaneous item(s). Various changes, improvements and modifications to the vertical forward grip, will be clearly recognized in the illustrations. Such modifications and specific design improvements of this current invention, along with a detailed description, are intended and included within the scope which is assessed only by a fair interpretation of the following claims.

Having fully described the improvements, along with a detailed description, in a clear and concise manner, to help assist with the understanding of the invention claimed.

The invention claimed is:

1. A firearm forward grip mounting device comprising:

a) a vertical forward grip assembly with an internal threads located inside and at a lower portion of the forward grip assembly, a dovetail mortise with an associated rail receiving cavity located at an upper portion of the forward grip assembly;

b) a grip cap tube with associated cap and with external threads located adjacent said associated cap; the internal threads gripping the external threads when the grip cap tube and the forward grip assembly as screwed together, c) a spring retention base plate located inside of the rail receiving cavity and said retention base plate attached to the vertical forward grip assembly;

d) a mounting clamp that includes a bar attached at a mounting clamp upper side and a rectangular base plate attachable to the mounting clamp; and e) the spring retention base plate including a central opening receiving the bar wherein the bar extends above the central opening when the mounting device is in an engaged position, and the central opening receiving the bar but the bar not extending above the central opening when the mounting device is in a disengaged position; and f) a spring element that acts to bias the mounting clamp with associated said bar into the disengaged position.

2. A firearm forward grip mounting device as claimed in claim 1, further comprising an O-ring located between the vertical forward grip assembly and the grip cap tube.

3. A firearm forward grip mounting device as claimed in claim 2, further comprising a second O-ring located between the mounting clamp and the rectangular base plate.

4. A firearm forward grip mounting device as claimed in claim 1, wherein the spring element is retaining springs located between the spring retention base plate and the mounting clamp.

5. A firearm forward grip mounting device as claimed in claim 4, wherein the internal threads and external threads are designed to provide quick turn-and-release for attaching and detaching the vertical forward grip assembly to the grip cap tube; and wherein the retaining springs are two springs located on opposite sides of the central opening.

6. A firearm forward grip mounting device as claimed in claim 1, further comprising four base plate retention screws to provide the attachment to the vertical forward grip assembly.

7. A firearm forward grip mounting device as claimed in claim 6, further comprising an index finger cradle feature located on the vertical forward grip assembly to assist in stabilization of a firearm.

8. A firearm forward grip mounting device as claimed in claim 1, further a base mount screw for attaching said retention base plate to the vertical forward grip assembly.

9. A firearm forward grip mounting device as claimed in claim 1, further comprising an thumb-index finger stabilization cradle feature located on the vertical forward grip assembly to assist in stabilization of a firearm.

10. A firearm forward grip mounting device as claimed in claim 1, further comprising an index finger cradle feature located on the vertical forward grip assembly to assist in stabilization of a firearm.

11. A firearm forward grip mounting device as claimed in claim 9, wherein the grip cap tube has an interior cavity to provide storage for batteries.

* * * * *